US007946567B2

(12) United States Patent
Taguchi

(10) Patent No.: US 7,946,567 B2
(45) Date of Patent: May 24, 2011

(54) POST-PROCESSING APPARATUS WITH PEAK POWER CONSUMPTION CONTROL

(75) Inventor: Hiroyuki Taguchi, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 139 days.

(21) Appl. No.: 12/402,020

(22) Filed: Mar. 11, 2009

(65) Prior Publication Data

US 2009/0230605 A1 Sep. 17, 2009

Related U.S. Application Data

(60) Provisional application No. 61/036,445, filed on Mar. 13, 2008.

(51) Int. Cl.
*B65H 37/04* (2006.01)
*B65H 37/06* (2006.01)

(52) U.S. Cl. ..... 270/58.09; 270/58.08

(58) Field of Classification Search ..... 270/58.07, 270/58.08, 58.09

See application file for complete search history.

(56) References Cited

U.S. PATENT DOCUMENTS

| | | | | |
|---|---|---|---|---|
| 5,730,438 | A * | 3/1998 | Webb et al. | 270/58.08 |
| 6,305,681 | B1 * | 10/2001 | Watanabe et al. | 270/58.08 |
| 6,361,036 | B1 * | 3/2002 | Nakazawa | 270/58.07 |
| 7,240,898 | B2 * | 7/2007 | Takamura et al. | 270/58.09 |

FOREIGN PATENT DOCUMENTS

| | | | |
|---|---|---|---|
| JP | 2000321940 | A * | 11/2000 |
| JP | 2003-008476 | | 1/2003 |
| JP | 2004-138840 | | 5/2004 |
| JP | 2007-124829 | | 5/2007 |

* cited by examiner

*Primary Examiner* — Patrick Mackey
(74) *Attorney, Agent, or Firm* — Patterson & Sheridan, LLP

(57) ABSTRACT

A console unit recognizes an operation schedule of a punch unit and a saddle unit based on an operation instruction received from an MFP. Further, the console unit determines, based on a result of the recognition, whether start timings of motors and solenoids in the respective units overlap with each other between the respective units. When the result of the determination is affirmative, the console unit controls execution timings of operations of the respective units corresponding to the operation instruction to prevent the start timings of the motors and the solenoids in the respective units from overlapping with each other between the respective units.

10 Claims, 4 Drawing Sheets

POST-PROCESSING APPARATUS WITH PEAK POWER CONSUMPTION CONTROL

CROSS-REFERENCE TO RELATED APPLICATION

This application is based upon and claims the benefit of priority from U.S. provisional application 61/036,445, filed on Mar. 13, 2008, the entire contents of which are incorporated herein by reference.

TECHNICAL FIELD

Disclosed herein relates to a post-processing apparatus for post-processing one or more sheets on which an image is formed by an image forming apparatus.

BACKGROUND

A post-processing apparatus for an image forming apparatus performs post-processing, such as stapling, punch hole formation, folding, sorting or inserting, on one or more sheets on which an image is formed by the image forming apparatus such as an MFP.

The post-processing apparatus includes plural motors, plural solenoids and the like as plural driving devices. The power source unit of the MFP outputs power necessary for its own operation, and also outputs power necessary for the operation of the post-processing apparatus.

When the respective driving devices of the post-processing apparatus operate, current flows from the power source unit to the respective driving devices. The current increase at the time of start of the driving device, decreases after the start and is stabilized.

Thus, when the plural driving devices simultaneously start, the output current of the power source unit significantly increases. When the power source unit can not deal with the significant increase of the output current, the respective driving devices can not be started.

The cost of the power source unit having large power capacity for preventing such disadvantage is high.

SUMMARY

A post-processing apparatus for an image forming apparatus disclosed herein includes:

a first post-processing unit having at least one driving device;

one or more second post-processing units having at least one driving device; and a control section for the first post-processing unit, that recognizes an operation schedule of the second post-processing unit based on an operation instruction received from the image forming apparatus, determines, based on a result of the recognition, whether start timings of the driving devices in the post-processing units overlap with each other between the post-processing units, and controls, when a result of the determination is affirmative, execution timings of operations of the post-processing units corresponding to the operation instruction to prevent start timings of the driving devices in the post-processing units from overlapping with each other between the post-processing units.

DESCRIPTION OF THE DRAWINGS

The accompanying drawings, which are incorporated in and constitute a part of the specification, illustrate embodiment, and together with the general description given above and the detailed description of the preferred embodiment given below, serve to explain the principles of the disclosure.

DETAILED DESCRIPTION

Hereinafter, an embodiment will be described with reference to the drawings.

Figure 1:
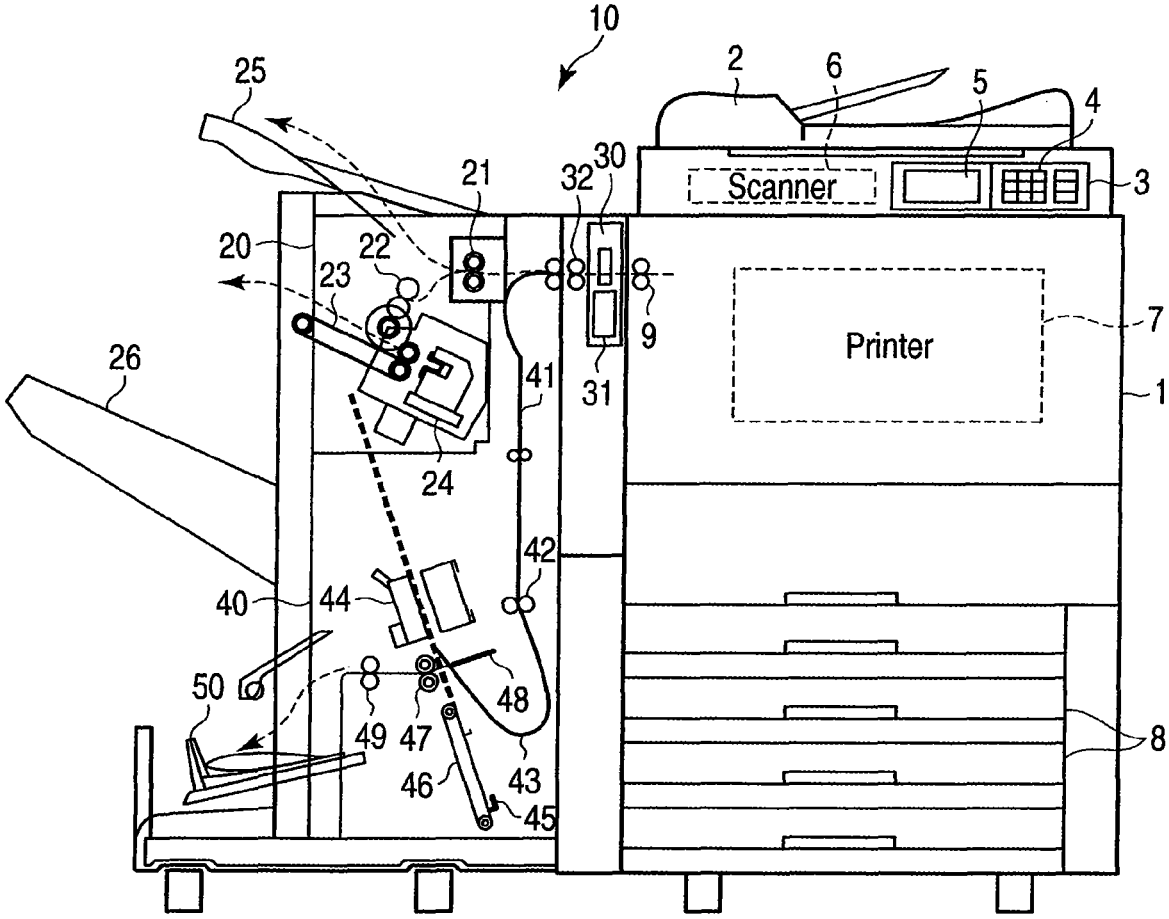
FIG. 1 is a view showing a structure of an embodiment of an image forming apparatus.

As shown in FIG. 1, a post-processing apparatus 10 is provided to be adjacent to an image forming apparatus such as an MFP (Multi-Function Peripherals) 1. The MFP 1 includes an auto document feeder (ADF) 2 which is openably and closably provided on a document stand at an upper part. Besides, the MFP 1 includes an operation panel 3 at the upper part. The operation panel 3 includes a key operation section 4 on which various keys are arranged, and a touch-panel liquid crystal display section 5.

Further, the MFP 1 includes a scanner 6, a printer 7 and plural cassettes 8. The scanner 6 optically reads an image of a document set on the document stand. The printer 7 prints the image read by the scanner 6 by a well-known image forming process onto a sheet supplied from each of the cassettes 8. The respective cassettes 8 contain many sheets. The MFP 1 ejects the sheet on which the image was formed by the printer 7 to the post-processing apparatus 10 by a eject roller 9.

The post-processing apparatus 10 includes a console unit 20 having a stapling function, a punch unit 30 to form a punch hole in a sheet ejected from the MFP 1, and a saddle unit 40 to fold a bundle of sheets ejected from the MFP 1.

A sheet ejected from the MFP 1 enters the punch unit 30, and is conveyed from the punch unit 30 to one of the console unit 20 and the saddle unit 40. The sheet passing through the console unit 20 is ejected to a tray 25. The sheet passing through the saddle unit 40 is ejected to a tray 26.

The punch unit 30 forms a punch hole at a previously determined position of the sheet ejected from the MFP 1, puts dust produced by the formation into a dust box 31, and sends the sheet subjected to the formation of the punch hole to one of the console unit 20 and the saddle unit 40 by a roller 32.

The console unit 20 has following portions (1) to (3) as main functions.

(1) A portion adapted to take in the sheet, which is sent from the punch unit 30, by a roller 21 and to eject the taken-in sheet to the tray 25.

(2) A portion adapted to take in the sheet, which is sent from the punch unit 30, by the roller 21, to place the taken-in sheet onto a conveying belt 23 one by one by a roller 22, to send a bundle of placed sheets to a stapler 24, to staple the sent bundle of sheets by the stapler 24, and to eject the bundle of sheets subjected to the stapling to the tray 26.

(3) A portion adapted to take in the sheet, which is sent from the punch unit 30, by the roller 21, to place the taken-in sheet on the conveying belt 23 by the roller 22, and to directly eject the placed sheet to the tray 26.

The saddle unit 40 has following portions (11) to (16) as main functions.

(11) A portion adapted to once guide the sheet sent from the punch unit 30 into a stapler 44 through a conveying path 41, a roller 42, and a conveying path 43 and to drop the sheet to a lower stack tray 45 one by one.

(12) A portion adapted to send a bundle of sheets stored on the stack tray 45 into the stapler 44 by the upward movement of the stack tray 45.

(13) A portion adapted to staple the center of the sent bundle of sheets by the stapler 44.

(14) A portion adapted to lower the bundle of sheets subjected to the stapling by the downward movement of the stack tray 45 and to cause the center of the bundle of sheets to face a pair of rollers 47.

(15) A portion adapted to push the center of the bundle of sheets facing the rollers 47 into between the rollers 47 by movement of a blade 48 and to fold the bundle of sheets in two by rotation of the rollers 47.

(16) A portion adapted to further fold the bundle of sheets, which was folded by the pushing of the blade 48 and the rotation of the rollers 47, by rotation of a pair of rollers 49 more intensely and to eject it to a tray 50.

The console unit 20, the punch unit 30 and the saddle unit 40 include DC motors, solenoids and the like as plural driving devices necessary for the operation.

Figure 2:
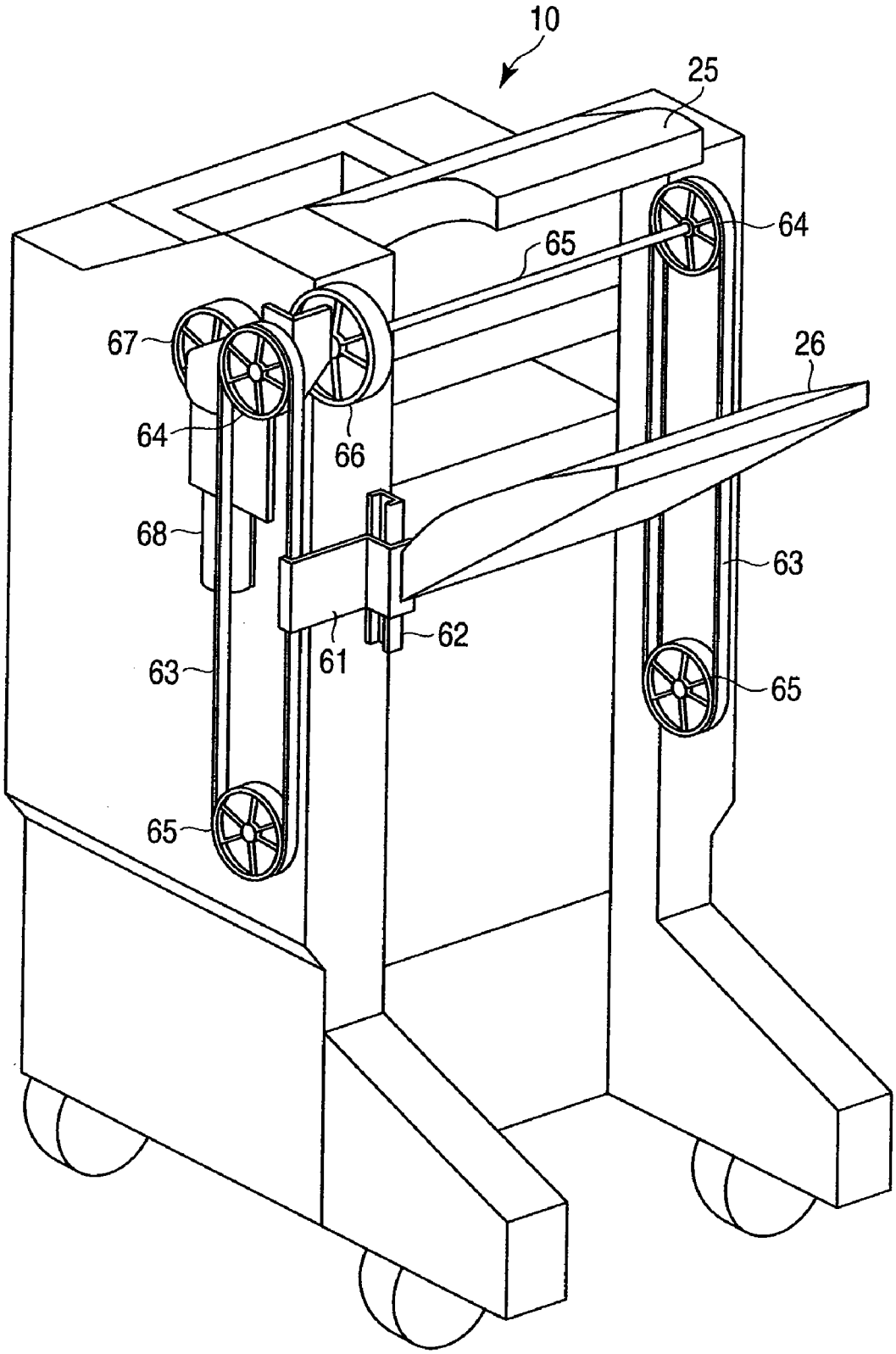
FIG. 2 is a perspective view showing an up-and-down moving mechanism of a tray of the embodiment.

FIG. 2 shows an up-and-down moving mechanism of the tray 26. That is, brackets 61 are provided at both sides of the tray 26, and the brackets 61 are attached to a pair of rails 62 of a housing of the post-processing apparatus 10 movably in an up-and-down direction. The brackets 61 are coupled to a pair of rotation belts 63, and the rotation belts 63 are stretched between a pair of pulleys 64 and a pair of pulleys 65. Rotation shafts of the pulleys 64 are coupled by a rod 65, and one end of the rod 65 is coupled to a DC motor 68 through gears 66 and 67. When the DC motor 68 forwardly rotates, the tray 26 moves upward. When the DC motor 68 reversely rotates, the tray 26 moves downward.

Figure 3:
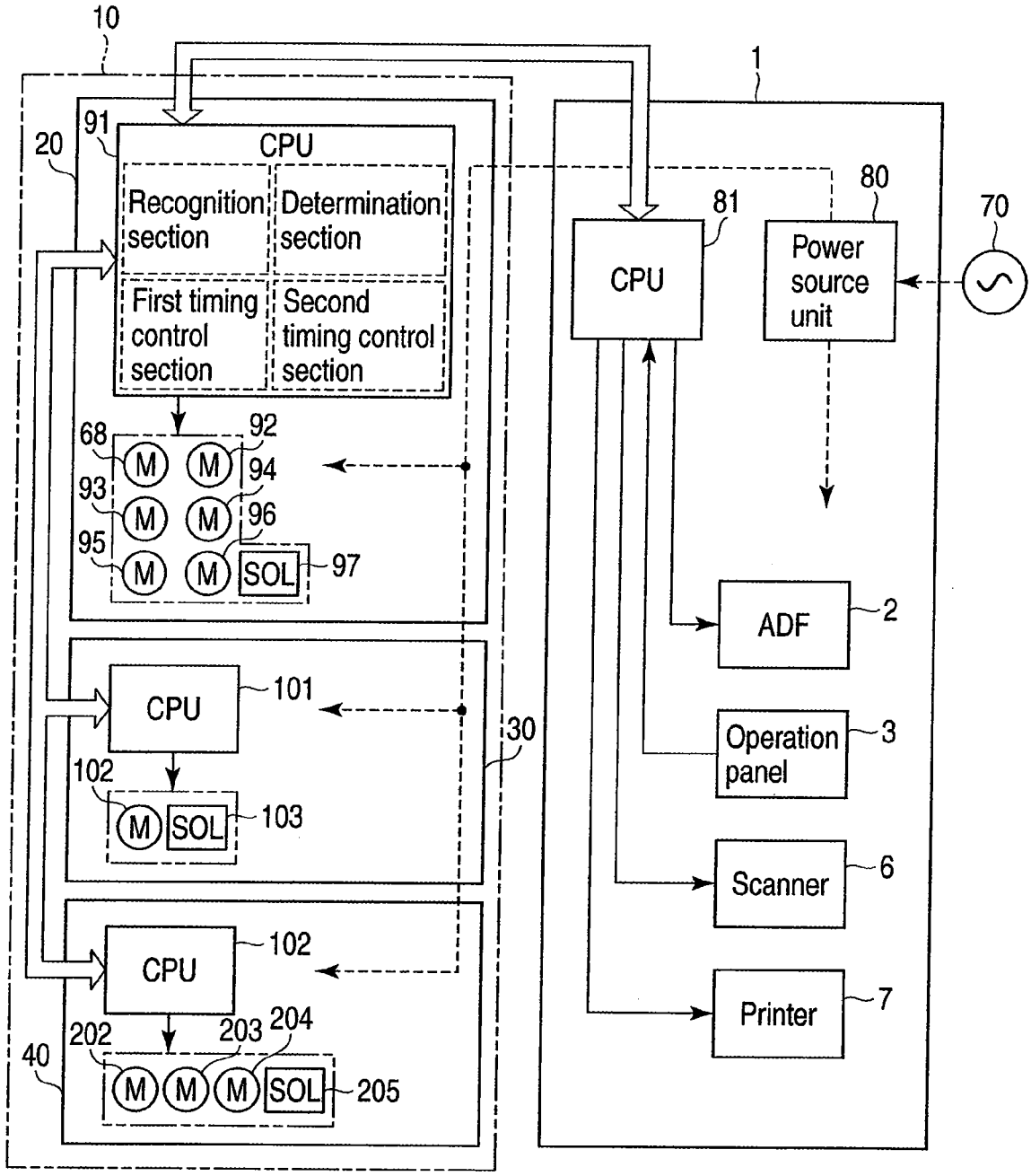
FIG. 3 is a block diagram of the embodiment.

FIG. 3 shows a control block of the MFP 1 and the post-processing apparatus 10 having the structure as stated above.

The MFP 1 includes a power source unit 80 and a CPU 81. The power source unit 80 converts power of a commercial AC power source 70 into power for operation of the MFP 1 and outputs it, and converts the power of the power source 70 into power for operation of the post-processing apparatus 10 and outputs it. As shown by a broken line in the drawing, a cable for power supply is provided from the power source unit 80 to the console unit 20, the punch unit 30 and the saddle unit 40 of the post-processing apparatus 10.

The CPU 81 controls the whole MFP 1, and gives an operation instruction to the post-processing apparatus 10.

In the console unit 20, the punch unit 30 and the saddle unit 40 of the post-processing apparatus 10, there is a relation between a higher unit and a lower unit in control. The console unit 20 is a first post-processing unit which is the higher unit, and each of the punch unit 30 and the saddle unit 40 is a second post-processing unit which is the lower unit.

The console unit 20 of the post-processing apparatus 10 includes a CPU 91 functioning as a controller, and includes, as driving devices, the DC motor 68, DC motors 92, 93, 94, 95 and 96, a solenoid 97 and the like. The punch unit 30 of the post-processing apparatus 10 includes a CPU 101 functioning as a controller, and includes, as driving devices, a DC motor 102, a solenoid 103 and the like. The saddle unit 40 of the post-processing apparatus 10 includes a CPU 201 functioning as a controller, and includes, as driving devices, DC motors 202, 203 and 204, a solenoid 205 and the like.

The CPU 81 of the MFP 1, the CPU 91 of the console unit 20, the CPU 101 of the punch unit 30, and the CPU 201 of the saddle unit 40 are mutually connected by a signal line.

The CPU 91 of the console unit 20 includes following sections (21) to (24) as a control section.

(21) A recognition section to recognize operation schedules of the console unit 20, the punch unit 30 and the saddle unit 40 based on the operation instruction received from the MFP 1.

(22) A determination section to determine, based on the recognition result of the recognition section, whether start timings of the driving devices (motors and solenoids) of the console unit 20, the punch unit 30 and the saddle unit 40 overlap with each other among the console unit 20, the punch unit 30 and the saddle unit 40.

(23) A first timing control section to control, when the determination result of the determination section is affirmative, execution timings of operations of the console unit 20, the punch unit 30 and the saddle unit 40 corresponding to the operation instruction, so that the start timings of the driving devices in the console unit 20, the punch unit 30 and the saddle unit 40 do not overlap with each other among the console unit 20, the punch unit 30 and the saddle unit 40.

(24) A second timing control section to cause, when the determination result of the determination section is negative, the operations of the console unit 20, the punch unit 30 and the saddle unit 40 corresponding to the operation instruction to be executed without delay.

Figure 4:
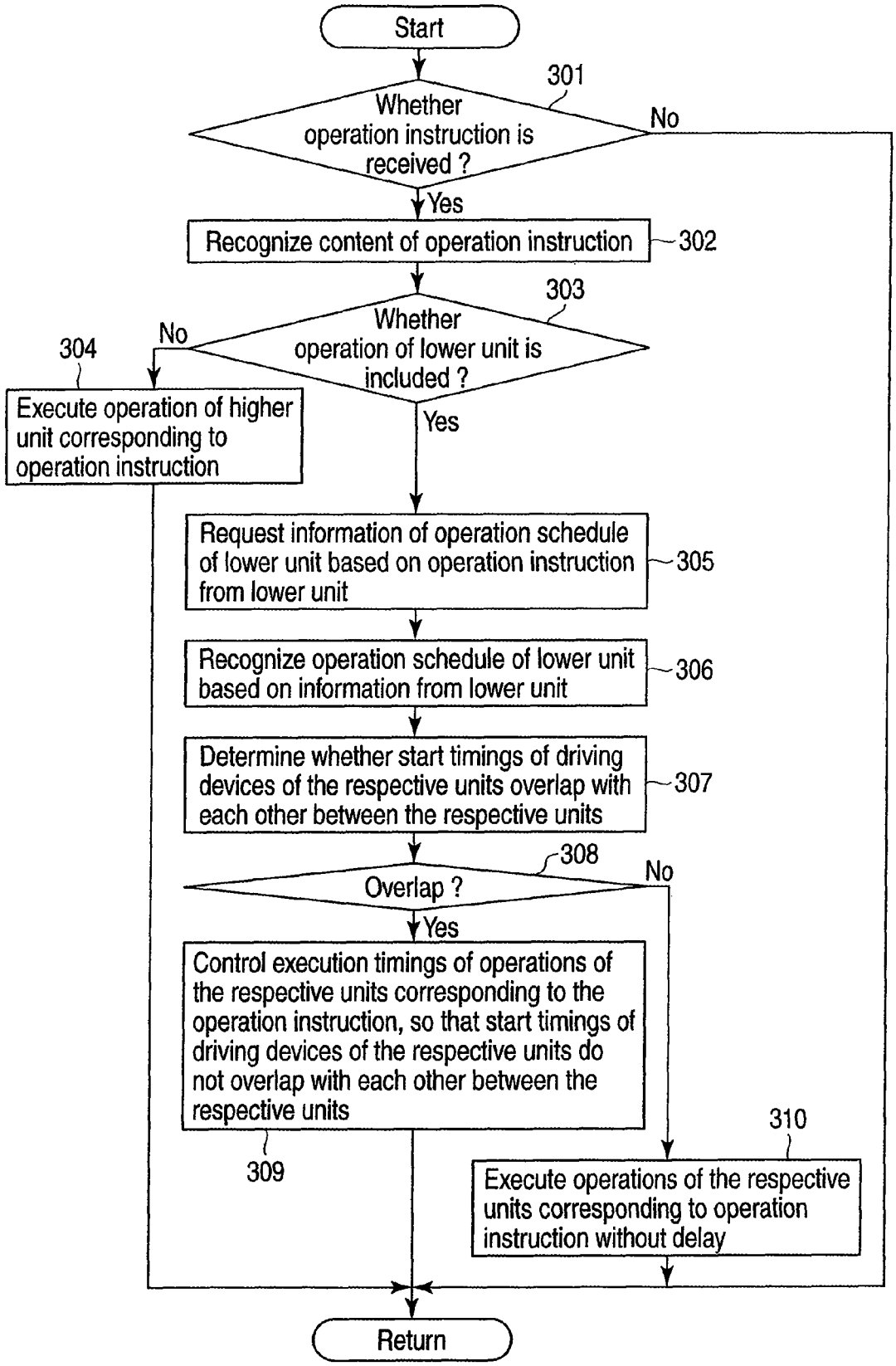
FIG. 4 is a flowchart for explaining control of the embodiment.

Next, an operation will be described. FIG. 4 is a flowchart showing the control of the CPU 91 of the console unit 20.

When receiving an operation instruction from the MFP 1 (YES at Act 301), the console unit 20 recognizes the content of the operation instruction (Act 302). Based on the result of the recognition, the console unit 20 determines whether the operation instruction includes an operation of one of the punch unit 30 and the saddle unit 40 as the lower unit (Act 303). When the result of the determination is negative (NO at Act 303), that is, when the operation instruction includes only the operation of the console unit 20, the console unit 20 executes the operation of the console unit 20 corresponding to the operation instruction (Act 304).

When the result of the determination is affirmative (YES at Act 303), for example, when the operation instruction includes the operation of the punch unit 30, the console unit 20 requests information of an operation schedule of the punch unit 30 from the punch unit 30 (Act 305). Besides, when the operation instruction includes the operation of the saddle unit 40, the console unit 20 requests information of an operation schedule of the saddle unit 40 from the saddle unit 40 (Act 305).

Besides, the console unit 20 analyzes the information sent from the punch unit 30 in response to the request, and recognizes the operation schedule of the punch unit 30 (Act 306). Further, the console unit 20 analyzes the information sent from the saddle unit 40 in response to the request, and recognizes the operation schedule of the saddle unit 40 (Act 307).

The console unit 20 determines, based on the recognized operation schedule, whether the start timings of the driving devices in the console unit 20, the punch unit 30 and the saddle unit 40 overlap with each other among the console unit 20, the punch unit 30 and the saddle unit 40 (Act 308).

When the result of the determination is affirmative (YES at Act 308), for example, when the start timing of one of the DC motors 68, 92, 93, 94, 95 and 96 and the solenoid 97 in the console unit 20 is scheduled to overlap with the start timing of one of the DC motor 102 and the solenoid 103 in the punch unit 30, the console unit 20 controls the execution timing of the operation of the console unit 20 corresponding to the operation instruction and the execution timing of the operation of the punch unit 30 corresponding to the operation instruction, so that the overlap does not actually occur (Act 309). As a specific example, the console unit 20 sends the operation instruction immediately to the punch unit 30 to first execute the operation of the punch unit 30, and after a specified time, for example, 10 msec passes from the start of the operation, the operation of the console unit 20 is executed.

When the result of the determination is affirmative (YES at Act 308), for example, when the start timing of one of the DC motors 68, 92, 93, 94, 95 and 96 and the solenoid 97 in the console unit 20 is scheduled to overlap with the start timing of one of the DC motors 202, 203 and 204 and the solenoid 205 in the saddle unit 40, the console unit 20 controls the execution timing of the operation of the console unit 20 corresponding to the operation instruction and the execution timing of the operation of the saddle unit 40 corresponding to the operation instruction, so that the overlap does not actually occur (Act 309). As a specific example, the console unit 20 first executes the operation of the console unit 20, and after a specified time, for example, 10 msec passes from the start of the operation, the console unit sends the operation instruction to the saddle unit 40 to execute the operation of the saddle unit 40.

When the result of the determination is affirmative (YES at Act 308), for example, when the start timing of one of the DC motor 102 and the solenoid 103 in the punch unit 30 is scheduled to overlap with the start timing of one of the DC motors 202, 203 and 204 and the solenoid 205 in the saddle unit 40, the console unit 20 controls the execution timing of the operation of the punch unit 30 corresponding to the operation instruction and the execution timing of the operation of the saddle unit 40 corresponding to the operation instruction, so that the overlap does not actually occur (Act 309). As a specific example, the console unit 20 immediately sends the operation instruction to the punch unit 30 to first execute the operation of the punch unit 30, and after a specified time, for example, 10 msec passes from the start of the operation, the console unit sends the operation instruction to the saddle unit 40 to execute the operation of the saddle unit 40.

When the result of the determination is affirmative (YES at Act 308), for example, when the start timing of one of the DC motors 68, 92, 93, 94, 95 and 96 and the solenoid 97 in the console unit 20, the start timing of one of the DC motor 102 and the solenoid 103 in the punch unit 30, and the start timing of one of the DC motors 202, 203 and 204 and the solenoid 205 in the saddle unit 40 are scheduled to overlap with one another, the console unit 20 controls the execution timing of the operation of the console unit 20 corresponding to the operation instruction, the execution timing of the operation of the punch unit 30 corresponding to the operation instruction, and the execution timing of the operation of the saddle unit 40 corresponding to the operation instruction, so that the overlap does not actually occur (Act 309). As a specific example, the console unit 20 immediately sends the operation instruction to the punch unit 30 to first execute the operation of the punch unit 30, and after a specified time, for example, 10 msec passes from the start of the operation, the operation of the console unit 20 corresponding to the operation instruction is executed, and after a specified time, for example, 10 msec passes after the start of the operation, the console unit sends the operation instruction to the saddle unit 40 to execute the operation of the saddle unit 40.

On the other hand, when the result of the determination is negative (NO at Act 308), for example, when the start timing of each of the DC motors 68, 92, 93, 94, 95 and 96 and the solenoid 97 in the console unit 20 is not scheduled to overlap with the start timing of each of the DC motor 102 and the solenoid 103 in the punch unit 30, the console unit 20 executes the operation of the console unit 20 corresponding to the operation instruction without delay, and immediately sends the operation instruction to the punch unit 30 to execute the operation of the punch unit 30 without delay (Act 310).

When the result of the determination is negative (NO at Act 308), for example, when the start timing of each of the DC motors 68, 92, 93, 94, 95 and 96 and the solenoid 97 in the console unit 20 is not scheduled to overlap with the start timing of each of the DC motors 202, 203 and 204 and the solenoid 205 in saddle unit 40, the console unit 20 executes the operation of the console unit 20 corresponding to the operation instruction without delay, and immediately sends the operation instruction to the saddle unit 40 to execute the operation of the saddle unit 40 without delay (Act 310).

When the result of the determination is negative (NO at Act 308), for example, when the start timing of each of the DC motor 102 and the solenoid 103 in the punch unit 30 is not scheduled to overlap with the start timing of each of the DC motors 202, 203 and 204 and the solenoid 205 in the saddle unit 40, the console unit 20 immediately sends the operation instruction to the punch unit 30 and the saddle unit 40 to execute the operation of the punch unit 30 and the saddle unit 40 without delay (Act 310).

When the result of the determination is negative (NO at Act 308), for example, when the start timing of each of the DC motors 68, 92, 93, 94, 95 and 96 and the solenoid 97 in the console unit 20, the start timing of each of the DC motor 102 and the solenoid 103 in the punch unit 30, and the start timing of each of the DC motors 202, 203 and 204 and the solenoid 205 in the saddle unit 40 are not scheduled to overlap with one another, the console unit 20 executes the operation of the console unit 20 corresponding to the operation instruction without delay, and immediately sends the operation instruction to the punch unit 30 and the saddle unit 40 to execute the operation of the punch unit 30 and the saddle unit 40 without delay (Act 310).

As stated above, the respective driving devices of the console unit 20, the punch unit 30 and the saddle unit 40 are not simultaneously started, so that the peak of the current flowing from the power source unit 80 of the MFP 1 to the post-processing apparatus 10 can be suppressed to be low. Accordingly, it is not necessary to increase the electric power capacity of the power source unit 80. Thus, an image forming apparatus in which the respective driving devices can be certainly started can be provided without increase in cost.

Incidentally, in the embodiment, although the console unit 20, the punch unit 30, and the saddle unit 40 are used as the post-processing unit, no limitation is made to those, and a sort unit, an insert unit and the like may be used.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. A post-processing apparatus for an image forming apparatus, comprising:

a console unit to staple sheets on which images are formed by the image forming apparatus, the console unit including at least one driving device;

a punch unit to form a punch hole in a sheet or sheets on which an image is formed by the image forming apparatus, the punch unit including at least one driving device;

a saddle unit to fold a sheet or sheets on which an image is formed by the image forming apparatus, the saddle unit including at least one driving device; and a control section for the console unit, which recognizes an operation schedule of the punch unit and the saddle unit based on an operation instruction received from the image forming apparatus, determines, based on a result of the recognition, whether start timings of the driving devices in the console unit, the punch unit and the saddle unit overlap with each other, and controls, when a result of the determination is affirmative, execution timings of operations of the units corresponding to the operation instruction to prevent the start timings of the driving devices in the units from overlapping with each other.

2. An apparatus of claim 1, further comprising:

a power source unit to output power necessary for the operations of the console unit, the punch unit and the saddle unit.

3. An apparatus of claim 1, further comprising:

a power source unit that is provided in the image forming apparatus, outputs power necessary for an operation of the image forming apparatus, and outputs power necessary for the operations of the console unit, the punch unit and the saddle unit.

4. An apparatus of claim 1, wherein the driving device of the console unit includes at least one of motor and a solenoid, the driving device of the punch unit includes at least one of motor and a solenoid; and the driving device of the saddle unit includes at least one of motor and a solenoid.

5. An apparatus of claim 1, wherein the control section includes:

a recognition section to recognize the operation schedule of the punch unit and the saddle unit based on the operation instruction received from the image forming apparatus;

a determination section to determine, based on a recognition result of the recognition section, whether the start timings of the driving devices in the console unit, the punch unit and the saddle unit overlap with each other; and a timing control section to control, when a determination result of the determination section is affirmative, the execution timings of the operations of the console unit, the punch unit and the saddle unit corresponding to the operation instruction to prevent the start timings of the driving devices in the units from overlapping with each other.

6. An apparatus of claim 5, wherein when the determination result of the determination section is affirmative, the timing control section controls the execution timings of the operations of the console unit, the punch unit and the saddle unit corresponding to the operation instruction to prevent the start timings of the driving devices in the units from overlapping with each other, and when the determination result of the determination section is negative, the timing control section causes the operations of the units corresponding to the operation instruction to be executed without delay.

7. A control method of a post-processing apparatus which is for an image forming apparatus and includes a console unit to staple sheets on which images are formed by the image forming apparatus, the console unit including at least one driving device, a punch unit to form a punch hole in a sheet or sheets on which an image is formed by the image forming apparatus, the punch unit including at least one driving device, and a saddle unit to fold a sheet or sheets on which an image is formed by the image forming apparatus, the saddle unit including at least one driving device, comprising:

recognizing an operation schedule of the punch unit and the saddle unit based on an operation instruction received from the image forming apparatus;

determining, based on a result of the recognition, whether start timings of the driving devices in the console unit, the punch unit and the saddle unit overlap with each other; and controlling, when a result of the determination is affirmative, execution timings of operations of the console unit, the punch unit and the saddle unit corresponding to the operation instruction to prevent the start timings of the driving devices in the units from overlapping with each other.

8. A method of claim 7, further comprising:

executing the operations of the console unit, the punch unit and the saddle unit corresponding to the operation instruction without delay when the result of the determination is negative.

9. A method of claim 7, wherein the image forming apparatus includes a power source, and the power source unit outputs power necessary for an operation of the image forming apparatus, and outputs power necessary for an operation of the console unit, the punch unit and the saddle unit.

10. A method of claim 7, wherein the driving device of the console unit includes at least one of a motor and a solenoid, the driving device of the punch unit includes at least one of a motor and a solenoid, and the driving device of the saddle unit includes at least one of a motor and a solenoid.

* * * * *